United States Patent [19]

Pritchard, Jr.

[11] Patent Number: 4,688,640

[45] Date of Patent: Aug. 25, 1987

[54] ABANDONING OFFSHORE WELL

[75] Inventor: John J. Pritchard, Jr., Harvey, La.

[73] Assignee: Shell Offshore Inc., Houston, Tex.

[21] Appl. No.: 876,580

[22] Filed: Jun. 20, 1986

[51] Int. Cl.[4] ..... E21B 43/11

[52] U.S. Cl. ..... 166/365; 166/297

[58] Field of Search ..... 166/365, 297, 298, 285, 166/55, 55.1, 55.2, 335, 52; 175/4.51, 4.52, 4.55, 4.56; 102/320, 321, 306, 310

[56] References Cited

U.S. PATENT DOCUMENTS

| | | | |
|---|---|---|---|
| Re. 25,298 | 12/1962 | Bielstein | 175/4.51 |
| 2,796,023 | 6/1957 | Abendroth | 175/4.52 |
| 3,064,571 | 11/1962 | True | 175/4.51 |
| 3,110,257 | 11/1963 | Lebourg | 175/4.51 |
| 3,268,016 | 8/1966 | Bell | 175/4.51 |
| 3,366,188 | 1/1968 | Hicks | 166/297 X |
| 3,666,009 | 5/1972 | Stone | 166/285 X |
| 4,498,541 | 2/1985 | Brieger et al. | 166/297 |

*Primary Examiner*—Stephen J. Novosad
*Assistant Examiner*—Thuy M. Bui

[57] ABSTRACT

A method and apparatus for abandoning an offshore oil or gas well drilled into the ocean floor having a plurality of concentric strings of pipe having throughbores and spaced to form an annular space between adjacent pipe strings. The invention includes perforating the pipe string with an explosive charge of a size, composition, and velocity so as to only penetrate one pipe string without damaging or penetrating any other pipe string in the well.

22 Claims, 6 Drawing Figures

ABANDONING OFFSHORE WELL

BACKGROUND OF THE INVENTION

This invention relates to a method and apparatus for abandoning an offshore oil or gas well drilled into the ocean floor and having a plurality of concentric strings of pipe having throughbores and spaced to form an annular space between adjacent pipe strings.

Federal regulations concerning the abandonment of an oil or gas exploration well required that the a determination be made as to whether or not any gas exists in the annular spaces between concentric pipe or casing strings prior to plugging the pipe strings. Prior art and practice on this subject is only concerned with perforating the outer most casing of the well together with a layer of cement outside the casing in order to open up a production formation and allow oil to flow into the well. At times, more than one string of casing in the well was perforated along with the cement surrounding the outermost casing. A perforator was positioned against the wall of the well so as to get the greatest penetration of the bullets or shaped charge shot into the formation through the steel casing and several inches of cement.

It is the object of the present invention to provide a method and apparatus for abandoning a well by perforating a single string of casing of a series of concentric casing strings or pipe strings within a well without damaging or perforating the next adjacent string of casing, and subsequently testing for the presence of gas trapped between casings prior to plugging each casing with a concrete plug.

SUMMARY OF THE INVENTION

The present invention is directed to a method and apparatus for abandoning an offshore well from a vessel on the ocean surface by perforating a pipe string hung in the well with an explosive charge of a size, composition, and velocity so as to only penetrate one pipe string without damaging or penetrating any other pipe string in the well.

A wellhead assembly base is lowered to the ocean floor together with a conductor string that may be sunk or washed into the ocean floor after which it may be cemented therein. Blowout preventers and a marine conductor pipe or riser are then lowered into place from the vessel. Drilling operations are carried out in a normal manner until the well is completed to a preselected depth.

The well is then tested to determine the presence of hydrocarbons. If none are found, the well may be abandoned using the method and apparatus of the present invention.

A determination must be made as to whether or not any gas exists in each annular space between concentric pipe or casing strings prior to plugging the well.

A perforating device is lowered via a running pipe string through a conductor string from the vessel and into position against the inner wall of the casing to be perforated. Then, a weighted bar is dropped down through the running pipe string or tubing to actuate firing of the perforating device and exploding of the shaped charges so as to form the perforations in the wall of the innermost pipe string. If no gas exists in the annulus between the perforated string and the next surrounding pipe string, then the innermost pipe string is cut off at say, 500 feet below the ocean floor. A concrete plug of at least 150 feet in height is then set around the upper end of the innermost pipe string remaining in the well to form a seal. After cutting off that portion of pipe, the upper cutoff portion is then withdrawn from the well. The steps of perforating, testing for gas, cutting off casing and sealing the top thereof are repeated for the subsequent casing strings including the cutting off and sealing of the outmost conductor pipe or drive pipe.

An advantage of the present invention is that a single string of casing of a series of concentric casing strings or pipe strings within a well can be perforated without damaging or perforating the next adjacent string of casing. If more than one casing was to be perforated at one time, it would not be possible to know from which annulus detected gas came from.

The various features of novelty which characterize the invention are pointed out with particularity in the claims forming a part of this disclosure. For a better understanding of the invention, its operating advantages and specific object obtained by its uses, reference may be made to the accompanying drawings and descriptive matter in which there are illustrated preferred embodiments of the invention.

DESCRIPTION OF THE PREFERRED EMBODIMENT

Figure 1:
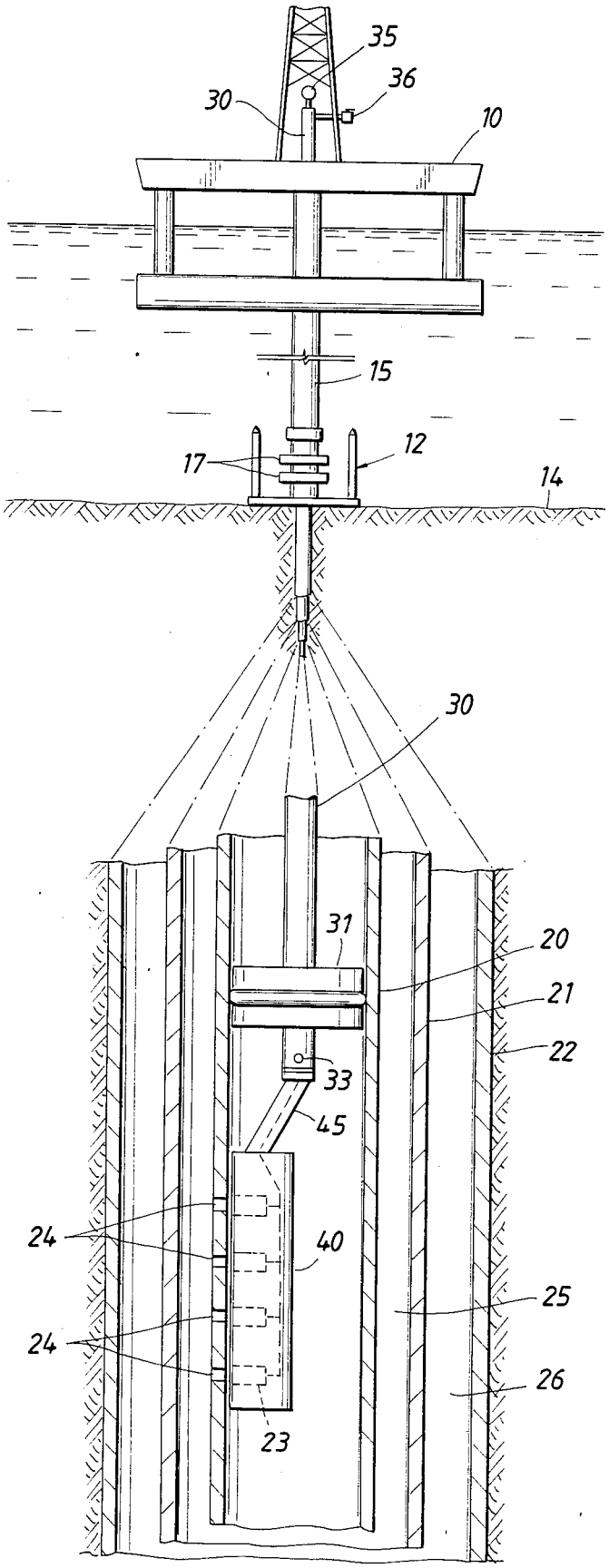
FIG. 1 is a diagrammatic view of an offshore well installation including a semi-submersible rig from which a well has been drilled into the ocean floor.

Referring to FIG. 1 of the drawing, an offshore well installation drilled from a semi-submersible rig 10 or jack-up rig may comprise a wellhead assembly base 12 which is run to the ocean floor 14 together with or separately from a conductor pipe string 15 that extends into the ocean floor 14 and is cemented therein. Blowout preventers 17 and a marine conductor pipe 15 are lowered into place from the vessel 10. All drilling is carried out through the marine conductor pipe 15 which extends from the vessel 10 to the top of the blowout preventers of the ocean floor wellhead assembly 12.

As the well is drilled to various depths, strings of well casing 20, 21 and 22 are run into the ocean floor 14 and cemented in place in the well. A smaller borehole is drilled down through the casing that has been set. Operations continue in a normal manner until the well is completed to a preselected depth.

After the well has been tested to determine the presence of hydrocarbons in the adjacent formations, and if none are found, the well is then abandoned using the method and apparatus of the present invention.

If gas is found in any annular space 25 and 26, the gas will flow into the interior of the running pipe string 30 below the packer 31 and will enter the circulation port 33 and flow upwardly through the running pipe string or tubing string 30 to the surface where it may be gauged using a pressure gauge 35 attached to the string 30. If only a small pocket of gas exists, it may be bled to the atmosphere using a relief valve 36. If gas continues to flow under pressure, it would be necessary to condition the well to prevent the accumulation of any further gas under pressure in the annular spaces 25 and 26. This may be done in any manner well known to the art, such for example, as perforating the pipe string 20 at a lower interval and injecting or squeezing cement (not shown) through injections into the annular space 25 to seal it.

Figure 2:
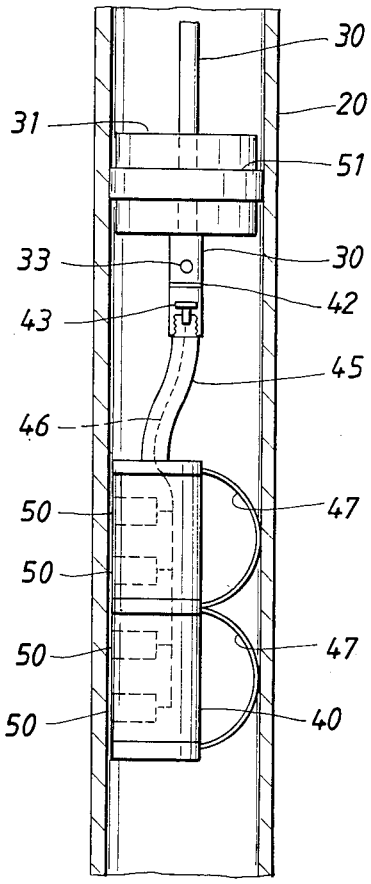
FIG. 2 is a diagrammatic view of a triggering device for actuating shaped charges of a casing perforator device.

The perforating device 40, shown in FIG. 2, is lowered down through the bore of the casing or pipe string 20 to be perforated using a conduit 30, say by connecting the perforator to a running pipe string or tubing string, and lowering it to a selected depth. The well is typically full of fluid (not shown) at the time, usually drilling mud. Since it is possible that some sediment may be accumulated on a disc 42 above a trigger 43, fluid is circulated down the tubing string 30 and out of a circulation port 33 prior to actuating a packer 31 carried on the pipe string 30 above the peforator, and setting the packer against the casing wall 20. However, this step is not essential and it may be left out many times, if desired. Coming out of the top of the perforating device 40 is a positioning arm 45 which may be a short length of flexible heavy wall hose as shown, with a flexible firing connection 46 such as an electrical blasting cord passing through it. If the casing 20 and perforator 40 have a diameter substantially less than that of the casing 20 through which it is being lowered, it may be desirable to provide leaf springs 47, as shown in FIG. 2, which are adapted to contact the inner wall of the casing 20 to be perforated and force the openings 50 of the perforator device against the opposite casing wall 20.

Figure 6:
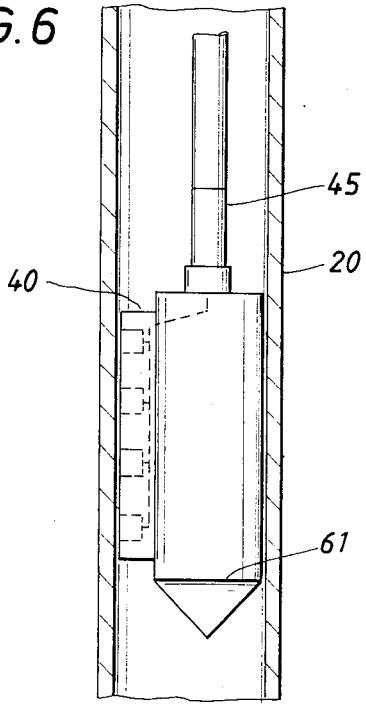
FIGS. 5 and 6 are cross-sectional views of additional embodiments of the present invention.
Figure 5:
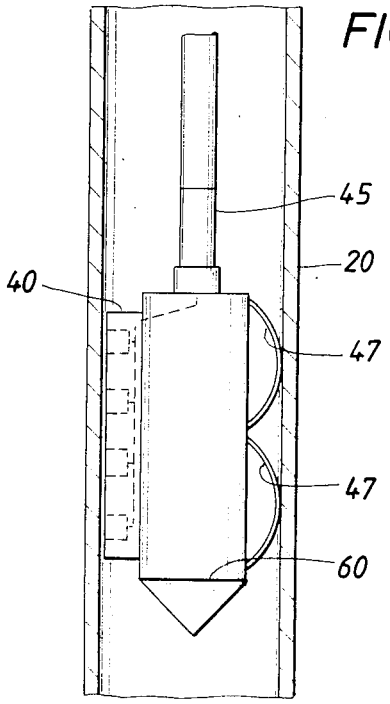

The arm 45 could be rigidly connected (FIG. 5) such as by welding the perforator 40 to a short section of casing 60, say 6 feet in length. The total width of the diameter of the perforating device 40 and the welded casing 60 should be no greater than the internal diameter of the casing string 20 it is being lowered through. Alternatively, a larger diameter short section of casing 61 (FIG. 6) may be used to position the perforator 40 adjacent to the casing wall 20 in lieu of the springs 47 shown in FIG. 5. As another alternative, to facilitate lowering of the perforating device, the positioning arm 45 may be offset as shown in FIG. 1.

Referring to FIG. 2, the upper end of the blasting cord 46 is connected to a firing device 43 having a spring mounted contact with a flat head at the top thereof. This type of igniter or firing device is actuated by dropping a weight (not shown) such as a heavy metal bar, through the tubing string 30 so that it will fracture the disc 42, if made of a friable material, such as glass, and then hit the firing pin 43 below it.

In the configuration shown in FIG. 2, a glass disc 42 above the firing pin 43 is inserted between two sections of the tubing string. The section just above the glass disc 42 is a short sub 30 having a circulating port 33 in it. Above the port is a packer 31, of any type well known to the art, which may be used to seal the interior bore of the casing 20 which is being perforated. A rubber seal 51 surrounding the circumference of the packer 31 may be used to ensure sealing in a fluid tight manner.

Figure 3:
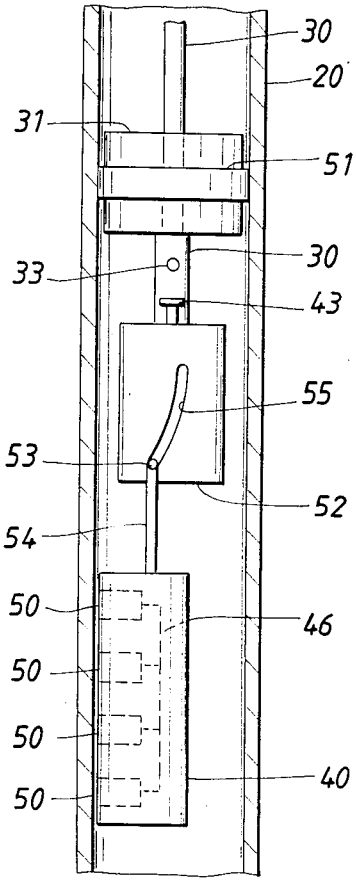
FIG. 3 is a diagrammatic view of a guiding device for locating or positioning the shaped charges at a selected depth.

FIG. 3 illustrates a perforating device 40 that has been lowered down through the well fluid (not shown) to its desired position in the well. The resistance of the well fluid against the bottom of the perforator 40 during the lowering operation will push it upwardly relative to the carrier plate or wedge 52 so that a traverse pin 53 at the top of the arm 54 connected to the perforator 40 will move to the top of the groove 55 in the plate or wedge 52. When the perforator 10 has been lowered to its desired position, the weight of the perforator 40 will pull the traverse pin 53 down along the curved groove 55 to the outer edge of the plate 52 thus moving the perforator 40 against the wall 20 of the borehole. Otherwise, the operation of this embodiment is the same.

Selection of the proper charge to be used for perforating the casing is very important. That is, selection of the proper strength charge is essential to perforating a single string of casing or pipe within a well without damaging or perforating the adjacent string of casing.

In one example, the innermost casing 20 (FIG.1) may be for example a $9\frac{5}{8}''$ diameter casing with a $\frac{1}{2}''$ wall, weighing 53 pounds per foot. The outer casing 21 may be a 72 pound pipe string $13\frac{3}{8}''$ in diameter with a $\frac{1}{2}''$ wall. The conductor pipe 22 may be 16 or 20" in diameter. A shaped charge 23 having 13 grams of explosive was found to be adequate to penetrate the $9\frac{5}{8}''$ casing wall 20 without knocking the rust off the wall of the next adjacent casing 21. However, 14 grams of explosive might damage the $13\frac{3}{8}''$ casing 21 string while 12 grams would not penetrate the $9\frac{5}{8}''$ casing 20.

High velocity deeply-penetrating charges, which are characteristically used in perforation operations, cannot be used in the present invention because these charges would open more than one annulus at a time between casings. Therefore, it would be difficult to determine from which annular space any gas was coming, if any was present.

A determination must be made as to whether or not any gas exists in the annular spaces between the concentric pipe or casing strings prior to plugging the pipe strings one at a time with a cement plug.

Referring to FIG. 1, the perforating device 40 having a rigid offset positioning arm 45 is lowered down through the running pipe string 30 and positioned against the inner wall of the casing 20. The packer 31 is set. Any debris above the trigger (not shown) has been washed out through a circulating port 33. A weighted bar (not shown) is dropped down through the running pipe string or tubing 30 to fire the perforating device 40 and explode the shaped charges 23 to form perforations 24 in the wall of the innermost pipe string 20.

Figure 4:
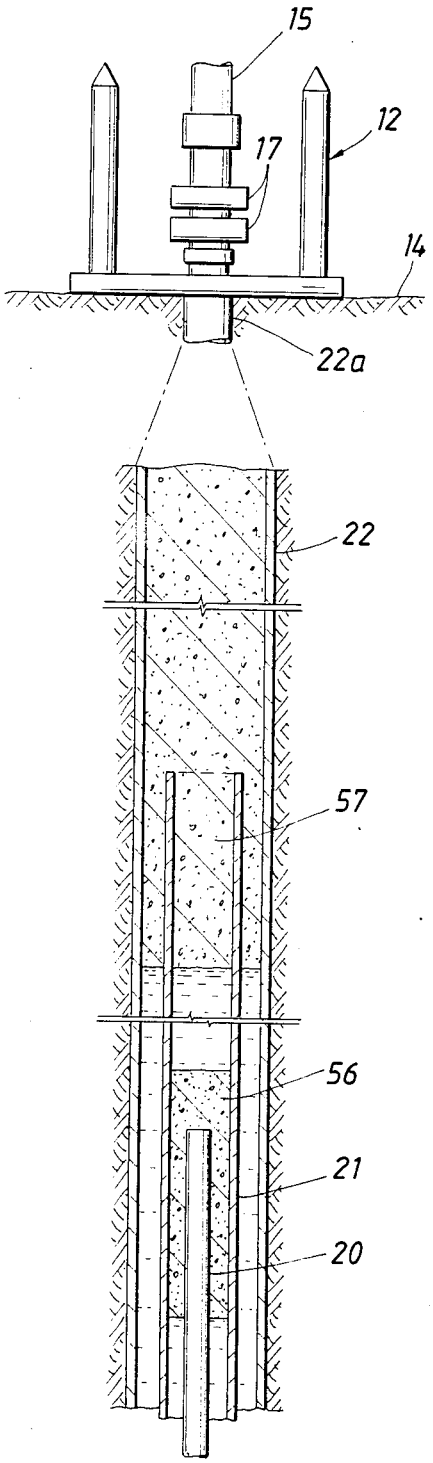
FIG. 4 is a cross-sectional view of an abandoned offshore well.

If no gas existed in the annulus 25 between the perforated string 20 and the next surrounding pipe string 21, the perforator is withdrawn to the surface along with the packer 31 above it and the innermost pipe string 20 is cut off at say, abot 500 feet below the ocean floor 14 as shown in FIG. 4. A concrete plug 56 of at least 150 feet in height is then set around the upper end of the innermost pipe string 20 remaining in the well to form a seal. After cutting off that portion of pipe 20, the upper cutoff portion can be withdrawn from the well. A new packer (not shown) is installed which is of a size that will seal inside the next largest pipe string or outer casing 21. The steps previously recited are then carried out. That is, the perforator 40 and packer are run into the well 21. The packer is set, the perforator 40 is fired, the existence of gas in the annular space 26 is determined, and then this pipe 21 is cut off (FIG. 4) at a selected depth so that a 150 foot concrete plug 57 will be formed at the top of the cutoff pipe 21 with the top of the plug being at about 145 foot from the ocean floor, as called for by government regulations. After the cement plug 57 is set up, the outmost conductor pipe string or drive pipe 22 is cut off or exploded at about 15 feet below the ocean floor. The stub 22*a* of the conductor 22 that remains connected to the ocean floor wellhead assembly 12 is then retrieved by pulling it back to the vessel 10.

Thus, it can be seen that the above-mentioned objective may be accomplished, based on the description of the preferred embodiment, by practicing the above-described method.

I claim as my invention:

1. In a method for abandoning an offshore oil or gas well drilled into the ocean floor and having a plurality of concentric strings or pipe having throughbores and being arranged in spaced relationship so as to form an annular space between adjacent pipe strings, with a wellhead being secured to the upper ends of said pipe strings which are substantially filled with a well fluid, the steps which comprise;

(a) establishing fluid flow communication through the wall of the innermost pipe string only between the bore thereof and the annular space outside at a selected depth in the well below the ocean floor, (b) determining the presence of gas under pressure in the annular space outside said innermost pipe string, (c) releasing any gas under pressure from the annular space outside said innermost pipe string, (d) cutting of the upper portion of the innermost pipe string at a selected level if no gas under pressure has been found under second step above, (e) removing said cutoff upper portion of said pipe string from the well, (f) spotting a volume of cement slurry in the well above the cutoff end of the innermost pipe string to close the cutoff end with a concrete plug of selected height, and (g) repeating at a level above the concrete plug the above steps (a) through (f) for the pipe string immediately outside of said concrete plug, which pipe string formerly surrounded the cutoff section of the innermost pipe string.

2. The method of claim 1 including the step of severing at a selected point below the ocean flow the last pipe string connected to the wellhead and removing the wellhead and pipe string connected thereto from the ocean floor.

3. The method of claim 1 including the steps of determining whether there is a continuing flow of gas into the well into said annular space after releasing the gas under step (c) above, and subseqently conditioning the well to prevent the accumulation of any further gas under pressure in said annular space.

4. The method of claim 3 wherein the well is subsequently conditioned by injecting a cement slurry at a selected depth in said annular space to shut off any further flow of gas thereinto.

5. The method of claim 1 wherein the step of establishing fluid flow through the wall of said pipe string is carried out by perforating said pipe string at a selected depth with an explosive charge selected of a size, composition and velocity so as to only penetrate one pipe string of known weight and strength in the well without damaging or penetrating any other pipe string in the well.

6. The method of claim 5 wherein the explosive charge is positioned adjacent to the inner wall of the pipe string being penetrated.

7. The method of claim 5 including the step of temporarily packing off the bore of said pipe string above the explosive charge prior to exploding said charge.

8. The method of claim 7 including the steps of lowering the perforating gun and an expandable packer positioned thereabove through the well to a selected depth on the lower end of a running pipe string, expanding the packer to close off the space above the perforating gun within the pipe string being penetrated, dropping gun actuating means through said running pipe string to fire the gun, and providing fluid flow communication between the space below said packer to the top of the well.

9. The method of claim 8 including the step of closing the top of the running pipe string at the surface and gauging the pressure of gas accumulating in said running pipe string.

10. An apparatus for abandoning an offshore oil or gas well drilled into the ocean floor comprising:

a plurality of concentric strings of pipe having throughbores and being arranged in spaced relationship so as to form an empty or gas-filled annular space between adjacent pipe strings, and a wellhead assembly being secured to the upper ends of said pipe strings which are substantially filled with a fluid, perforating means lowerable through the innermost string of pipe for perforating the casing wall of each string of pipe separately and individually without damaging the next outermost string of pipe, and guiding conduit means extending from the wellhead assembly to the water surface for guiding said perforating means therethrough and through the wellhead assembly.

11. The apparatus of claim 10 wherein said perforating means comprises:

explosive charges for perforating said casing wall;

triggering means operatively engageable with said charges to activate said charges;

means for carrying said charges, said means having a diameter less than the casing to be perforated;

positioning means operatively connected to said carrying means for locating said charges adjacent to said casing wall;

weight-supporting lowering means operatively connected to said positioning means for lowering said carrying means into said pipe string.

12. The apparatus of claim 11 wherein said lowering means includes port means above said triggering means for discharging a circulating fluid from said pipe string to remove debris from above said triggering means.

13. The apparatus of claim 11 including a packer having substantially the same diameter as the casing to be perforated and carried by said lowering means, said packer being adapted to be positioned within the bore of said casing in a fluid-tight manner.

14. The apparatus of claim 13 wherein said packer includes a rubber seal carried on the outer surface thereof to be positioned in an annulus formed between the packer and the interior wall of said casing.

15. The apparatus of claim 11 wherein the longitudinal axis of said positioning means is nonparallel with the longitudinal axis of said pipe string to be perforated and with the carrying means.

16. The apparatus of claim 11 wherein the carrying means includes spring means on one side for positioning carrying means and said charges adjacent to the inner casing wall to be perforated.

17. The apparatus of claim 11 wherein said triggering means comprises:

firing means for activating said charges; and actuating means lowerable through said pipe string to be perforated for actuating said firing means.

18. The apparatus of claim 17 wherein said triggering means includes a disc located above said firing means and substantially parallel with the latitudinal axis of said pipe string.

19. The apparatus of claim 11 wherein said positioning means is operatively rigid.

20. The apparatus of claim 11 wherein said positioning means is operatively flexible.

21. The apparatus for claim 17 wherein said firing means comprises:

first contact means being spring mounted and having a flat head at the top thereof; and blasting cord operatively connected with said charges and said first contact means.

22. The apparatus for claim 21 wherein said firing means includes:

second contact means positioned below said first contact means and operatively engageable therewith;

guiding means positioned below said second contact means and operatively engageable with said carrying means for positioning said charges adjacent to said casing wall to be perforated; and third contact means operatively engageable with said guiding means and said blasting cord to activate said charges.

* * * * *